United States Patent [19]

Boeke et al.

[11] Patent Number: 4,711,304

[45] Date of Patent: Dec. 8, 1987

[54] METHOD OF AND APPARATUS FOR INJECTION OF STEAM INTO MULTIPLE WELL ZONES

[75] Inventors: Eric J. Boeke; Milton E. McCoy, both of Bakersfield, Calif.

[73] Assignee: Camco, Incorporated, Houston, Tex.

[21] Appl. No.: 941,671

[22] Filed: Dec. 15, 1986

[51] Int. Cl.[4] ..... E21B 36/00; E21B 43/24

[52] U.S. Cl. ..... 166/303; 166/269; 166/242

[58] Field of Search ..... 166/269, 57, 272, 303, 166/313, 117.5, 117.6, 242

[56] References Cited

U.S. PATENT DOCUMENTS

| | | | |
|---|---|---|---|
| 2,973,039 | 2/1961 | Payne, Jr. | 166/269 |
| 3,130,784 | 4/1964 | Pennington | 166/269 |
| 3,455,382 | 7/1969 | Chenoweth | 166/269 |
| 4,399,865 | 8/1983 | Anderson et al. | 166/303 |
| 4,424,859 | 1/1984 | Sims et al. | 166/313 |
| 4,646,828 | 3/1987 | Schwab, Jr. et al. | 166/117.5 |
| 4,648,455 | 3/1987 | Luke | 166/269 |

OTHER PUBLICATIONS

Society of Petroleum Engineers Paper No. 15472, entitled "New Methods for Controlled Injection of Steam into Multiple Sands", by K. C. Hong and S. Griston, dated Oct. 5, 1986.

*Primary Examiner*—George A. Suchfield
*Assistant Examiner*—Bruce M. Kisliuk
*Attorney, Agent, or Firm*—Fulbright & Jaworski

[57] ABSTRACT

A method and apparatus for injecting steam containing water into a plurality of separated oil bearing zones for substantially equally dividing the injection of the water equally into the zones. A sidepocket mandrel with multiple pockets is positioned in the well tubing and includes a plug in the open bore for collecting water and directing the water substantially equally into each of the sidepockets for transmittal to the separated well zones.

10 Claims, 5 Drawing Figures

METHOD OF AND APPARATUS FOR INJECTION OF STEAM INTO MULTIPLE WELL ZONES

BACKGROUND OF THE INVENTION

It is often desirable to inject steam simultaneously into more than one well zone of an oil bearing formation for increasing the recovery of the oil. Various methods for performing this operation are described in the Society of Petroleum Engineers Paper No. 15472, entitled "New Methods for Controlled Injection of Steam Into Multiple Sands" dated Oct. 5, 1986. However, this paper points out that it is desirable to maintain the quality of steam injected into each different well zones. That is, if the steam quality is insufficient, by containing too much water, an unsatisfactory steam quality and flow rate division occur between the different zones. In one example given of a two zone steam injection, the top zone received quality steam, ranging from 60% to 80%, while the bottom zone received only 30% to 40% quality steam. That is, the bottom zone received most of the water in the steam.

The present invention is directed to a method of and apparatus for injecting steam containing water into multiple well zones to obtain a more uniform division of water to each zone. This is done by collecting the water in the steam and more evenly dividing the water between each of the well zones to provide a more uniform quality of steam injected into all of the zones even if the division of steam between the zones is not equal.

SUMMARY

The present invention is directed to an apparatus for injecting steam containing water into first and second separated well zones which includes a well tubing in a well extending through the first and second well zones. A mandrel is connected in the well tubing and includes an open bore and first and second sidepockets offset from the open bore. Fluid communication passageways are provided between the open bore and each of the sidepockets and the passageways are at substantially the same elevation. A flow control device is positioned in at least one and in the preferrred embodiment in each of the sidepockets and plug means are provided in the open bore below the passageways for collecting any water injected into the tubing for allowing the water to build up and flow substantially equally into both of the passageways. An exit port is connected to one of the sidepockets and is in communication with the first well zone and an exit port is connected to the second of the sidepockets and is in communication with the second well zone.

A still further object of the present invention is wherein the open bore is separated from the sidepockets by a wall and the passageways include a plurality of openings in the wall.

Yet a further object of the present invention is wherein the exit port connected to the second sidepocket is connected to the well tubing at a point below the plug means.

Still a further object is wherein a second sidepocket mandrel is connected in the well tubing adjacent the second well zone and has an open bore and a sidepocket in communication with the open bore and is in communication with the second well zone. The exit port of the second sidepocket of the first mandrel is in communication with the open bore of the second mandrel.

Still a further object of the present invention is the provision of a mandrel for use in a well tubing for receiving steam containing water for injection into first and second separated well zones including a mandrel body having upper and lower connections for connecting the body into a well tubing. The body includes an open bore for communication with a connected well tubing and a plurality of flow control device receiving sidepockets are offset relative to the open bore. Flow passageways are provided between the open bore and each of the sidepockets and the passageways are at substantially the same elevation. A plug receiving means is provided in the open bore for receiving a plug blocking the open bore thereby collecting any injected water and allowing the water to flow into all of the passageways. An exit port is connected to each of the sidepockets and extends out of the body for communication to one of the well zones. A plug is connected to the plug receiving means in the open bore and is positioned below the passageways.

Yet a still further object of the present invention is the method of injecting steam containing water into first and second separated well zones including injecting the steam containing water down the bore of a single well tubing and directing the steam into two different paths offset from the bore. One of the paths is directed into the first well zone and the other path is directed into the second well zone. The method includes collecting any water in the bore of the well tubing and directing substantially equal portions of the water into the two paths thereby substantially equalizing the water injected into the separated well zones.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

While the present apparatus and method of the present invention will be described for injecting steam containing water into first and second separated well zones, for purposes of illustration only, the present apparatus can be used for injecting steam into any desired number of well zones.

Figure 1:
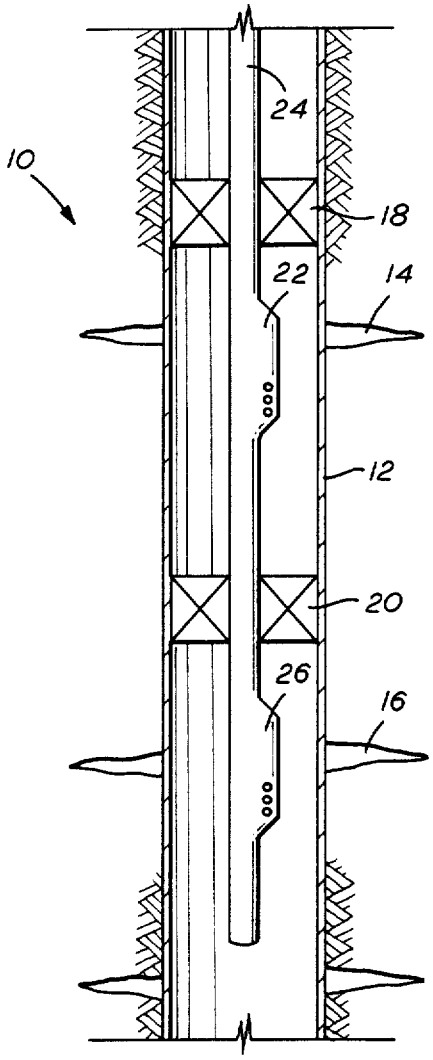
FIG. 1 (PRIOR ART)
FIG. 1 is a schematic elevational view illustrating one prior art type of steam flood installation for injecting steam into multiplied well zones.

Referring now to the prior art installation of FIG. 1, a steam flood installation generally indicated by the reference numeral 10 illustrates a well having a casing 12 extending through a first 14 and a second 16 well zone such as oil bearing formations. The zones 14 and 16 are separated by packers 18 and 20. A first sidepocket mandrel 22 is connected in a well tubing 24 for injecting steam from the tubing 24 into the first zone 14. A second sidepocket mandrel 26 is connected in the well tubing for injecting steam into the second well formation 16. While it is desirable to inject high quality or dry steam into the zones 14 and 16 the steam contains a significant amount of water which reduces the steam quality. In the prior art installation of FIG. 1, a majority of the water will bypass the first mandrel 22 and be injected into the second well zone 16. However, it is highly desirable to maintain the quantity of water and frequently the quantity of steam injected into each of the well zones 14 and 16 substantially equal.

Figure 2:
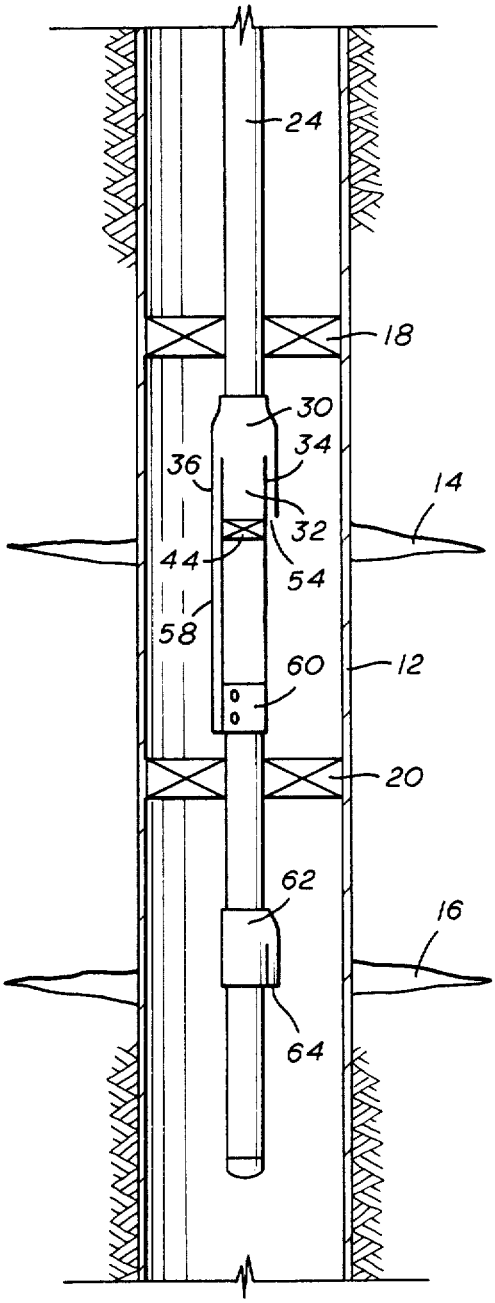
FIG. 2 is a schematic elevational view of the steam injection system of the present invention.
Figure 3A:
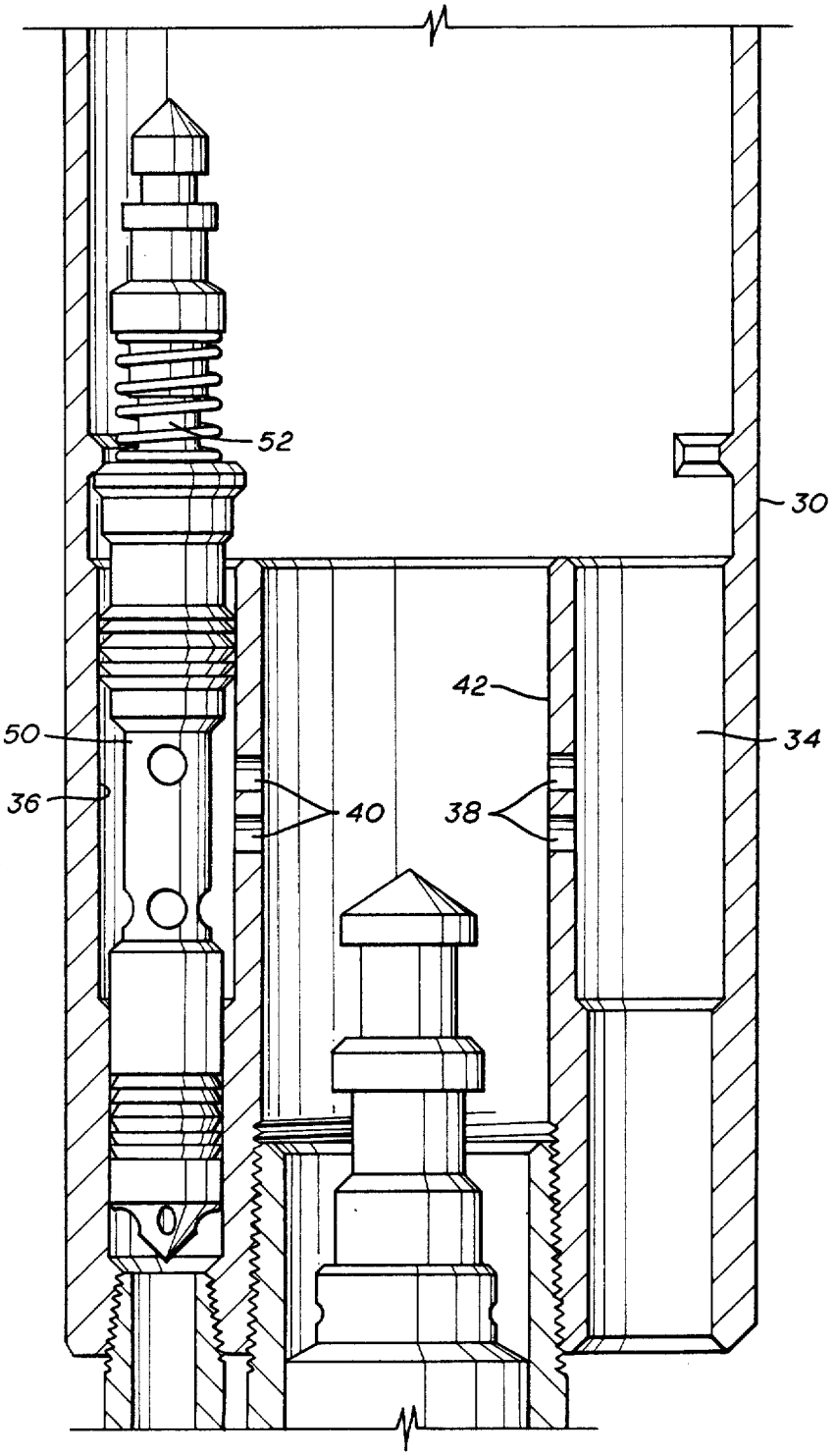
FIGS. 3A and 3B are enlarged elevational views, in cross section, and are continuations of each other illustrating a multiple sidepocket mandrel for dividing the injected steam and water into multiple zones.
Figure 3B:
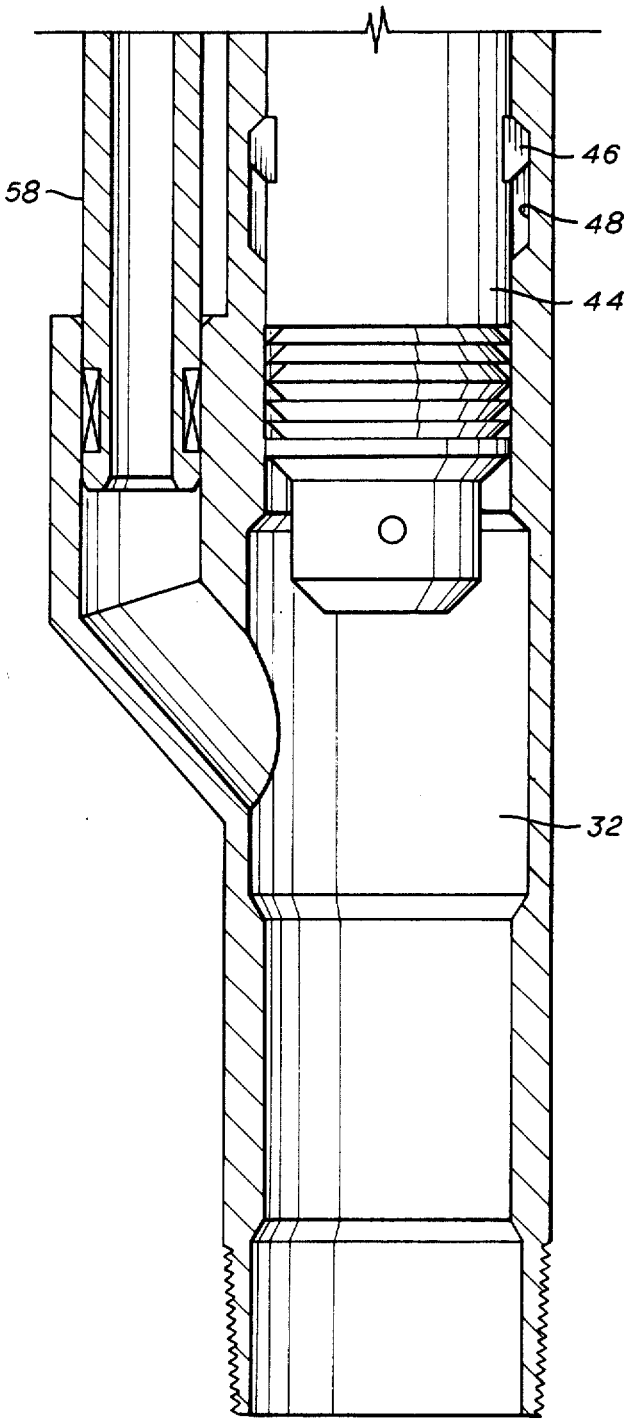

Referring now to FIGS. 2, 3A and 3B, the present invention is directed to providing a multipocket mandrel 30 such as disclosed in U.S. Pat. No. 3,874,445 in the well tubing 24 adjacent the first well zone 14. The mandrel 30 includes an open bore 32 in communication with the bore of the well tubing 24 and includes multiple sidepockets such as sidepockets 34 and 36 which are offset from the open bore 32. Fluid passageways 38 and 40 are provided in a wall 42 to provide communications between the open bore 32 and the sidepockets 34 and 36, respectively.

Suitable plug means are provided in the open bore 32 below the passageways 38 and 40 for receiving and collecting any water in the injected steam. The plug means 44 may be a blanking plug supported from a type C type lock sold by Camco, Incorporated which includes dogs 46 which engage a plug receiving means such as locking recess 48 in the open bore 32 of the mandrel 30. Preferably a flow control device 50 is installed in each of the sidepockets 34 and 36, as is conventional, by a latch 52 such as a type RK sold by Camco, Incorporated. The flow conrol devices 50 may be an orifice valve such as type RDO-20 sold by Camco, Incorporated. Thus, injected steam in the well tubing 24 will flow into the open bore 32 and equally through the passageways 38 and 40 to the orifice valves 50. (Whether the steam is divided evenly or not depends on the size of the orifices in the valves 50.) Water collected in the open bore 32 above the plug 44 will accumulate until it reaches the passageways 38 and 40 and will flow substantially equally to the valves 50.

An exit port 54 is connected to the sidepocket 34 and is in communication with the well zone 14. An exit port 56 is connected to the sidepocket 36 and is connected to the interior of the well tubing 24 such as through a snorkle tube 58 and a hydraulic nipple 60 such as type B sold by Camco, Incorporated for insertion into the bore of the well tubing 24 below the blanking plug 44. The steam and water from the second sidepocket 36 will pass from the well tubing 24 through any suitable opening such as a second conventional sidepocket mandrel 62 having an exit port 64 in communication with the second zone 16. Therefore, the multipocket mandrel 30 allows a substantial equal division of the water into each of the zones 14 and 16.

However, if desired, the orifice valve 50 in the sidepocket 36 may be omitted and instead inserted in the sidepocket of the second mandrel 62. The water would still be divided substantially equally in the mandrel 30 between the sidepockets 34 and 36 and the orifice valves in the one pocket 34 and in the mandrel 62 sidepocket could still control the desired division of steam to the well zones 14 and 16, respectively.

Figure 4:
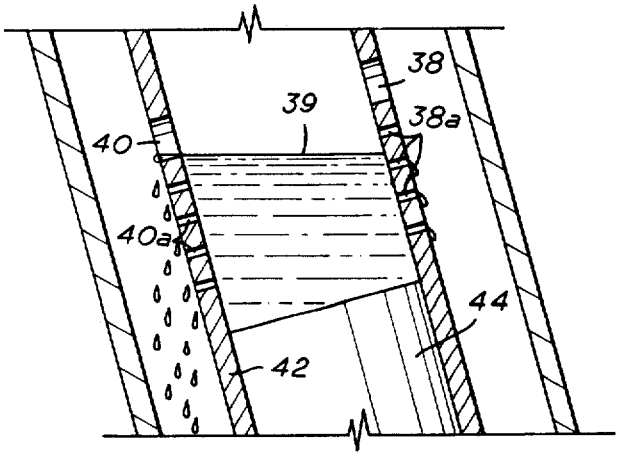
FIG. 4 is an elevational schematic illustrating the substantially equal division of water collected in the open bore of the multipocket mandrel when the mandrel is tilted.

Referring now to FIG. 4, the multiple sidepocket mandrel 30 may be installed in a well bore at a slight angle in some cases. In this event, the passageways 38 and 40 may include small openings **38*a* and 40*a*, respectively, in communication with the sidepockets 34 and 36, respectively. The small passages 38*a* and 40*a* impede the flow of water therethrough and therefore the water level 39 may rise above some of the holes 38*a* and 40*a* and maintain a substantially equal division of the water into the sidepockets 34 and 36**, respectively.

The method of the present invention of injecting steam containing water into first and second separated well zones is apparent from the foregoing description of the apparatus. The method includes injecting the steam containing water down the bore of a single well tubing and directing the steam into two different paths offset from the bore. The method includes directing one path into the first well zone and directing the other path into the second well zone. The method also includes collecting any water in the bore of the well tubing and directing substantially equal portions of the water into the two paths thereby substantially equalizing the water injected into the separated well zones. The method further includes whereby the water is collected in a container and overflows substantially equally into the two paths and may further include wherein the bore of the well tubing is blocked below the upper ends of the paths to form a container.

The present invention, therefore, is well adapted to carry out the objects and attain the ends and advantages mentioned as well as others inherent therein. While a presently preferred embodiment of the invention has been given for the purpose of disclosures, numerous changes in the details of construction, arrangement of parts, and steps of the method, will be readily apparent to those skilled in the art and which are encompassed within the spirit of the invention and the scope of the appended claims.

What is claimed is:

1. Apparatus for injection of steam containing water into first and second separated well zones comprising;

a weld tubing in a well extending through first and second well zones, a mandrel connected in the well tubing, said mandrel including an open bore, first and second sidepockets offset from the open bore, flow passageways communicating between the open bore and each of the sidepockets, said passageways to each of the sidepockets being at substantially the same elevation, a flow control device positioned in at least one of the sidepockets, plug means in the open bore below the passageways for collecting any water injected into the tubing for allowing the water to build up and flow into both of the passageways, an exit port connected to one of the sidepockets and in communication with the first well zone and an exit port connected to the second of the sidepockets and in communication with the second well zone.

2. The apparaus of claim 1 wherein said open bore is separated from the sidepockets by a wall and said passageways include a plurality of openings in said wall.

3. The apparatus of claim 1 wherein the exit port connected to the second sidepocket is connected to the well tubing at a point below the plug means.

4. The apparatus of claim 1 including a second sidepocket mandrel connected in the well tubing adjacent the second well zone, said second mandrel having an open bore and a sidepocket in communication with the open bore and in communication with the second well zone and the exit port of the second sidepocket of the first mandrel is in communication with the open bore of the second mandrel.

5. The apparatus of claim 1 including an orifice valve in each of the sidepockets.

6. A mandrel for use in a well tubing for receiving steam containing water for injection into first and second separated well zones comprising, a mandrel body having upper and lower connections for connecting the body into a well tubing, said body including an open bore for communication with a connected well tubing, a plurality of flow control device receiving sidepockets offset relative to the open bore, flow passageways between the open bore and each of the sidepockets, said passageways being at substantially the same elevation, plug receiving means in the open bore for receiving a plug blocking the open bore thereby collecting any injected water and allowing the water to flow into all of the passageways, and an exit port connected to each of the sidepockets and extending out of the body for communication to one of the well zones.

7. The apparatus of claim 6 including, a plug connected to the plug receiving means in the open bore and positioned below the passageways.

8. The method of injecting steam containing water into first and second separated well zones comprising, injecting the steam containing water down the bore of a single well tubing, directing the steam into two different paths offset from the bore, directing one path into the first well zone, directing the other path into the second well zone, collecting any water in the bore of the well tubing, and directing substantially equal portions of the water into the two paths thereby substantially equalizing the water injected into the separated well zones.

9. The method of claim 8 wherein the water is collected in a container and overflows substantially equally into the two paths.

10. The method of claim 9 wherein the bore of the well tubing is blocked below the upper ends of said paths to form the container.

* * * * *

UNITED STATES PATENT OFFICE

CERTIFICATE OF CORRECTION

Patent No. 4,711,304 Dated December 8, 1987

Inventor(s) Eric J. Boeke et al.

It is certified that error appears in the above-identified patent and that said Letters Patent are hereby corrected as shown below:

Column 2, line 42, change "multiplied" to -- multiple --

Column 4, line 40, change "weld" to -- well --

Signed and Sealed this

Seventh Day of June, 1988

*Attest:*

DONALD J. QUIGG

*Attesting Officer*

*Commissioner of Patents and Trademarks*